US005699727A

United States Patent [19]

Schwelling

[11] Patent Number: 5,699,727

[45] Date of Patent: Dec. 23, 1997

[54] METHOD OF MANUALLY TYING BALES IN WASTE MATERIAL PRESSES

[76] Inventor: Hermann Schwelling, Hartmannweg 5, 88682 Salem, Germany

[21] Appl. No.: 576,804

[22] Filed: Dec. 21, 1995

[30] Foreign Application Priority Data

Dec. 24, 1994 [DE] Germany ..... 44 46 748.6

[51] Int. Cl.[6] ..... B65B 27/12; B30B 9/30

[52] U.S. Cl. ..... 100/3; 100/24; 100/25; 100/34

[58] Field of Search ..... 100/1–3, 8, 24, 100/25, 34

[56] References Cited

U.S. PATENT DOCUMENTS

| | | | |
|---|---|---|---|
| 953,329 | 3/1910 | Ginaca | 100/34 |
| 1,142,188 | 6/1915 | Macomber | 100/34 |
| 5,575,199 | 11/1996 | Yamamoto | 100/24 |

FOREIGN PATENT DOCUMENTS

| | | | |
|---|---|---|---|
| 2658337 | 7/1978 | Germany | 100/3 |
| 3238542 | 4/1984 | Germany | 100/8 |
| 3238573 | 4/1984 | Germany | 100/8 |
| 63-108999 | 5/1988 | Japan | 100/25 |
| 461020 | 4/1975 | U.S.S.R. | 100/3 |

*Primary Examiner*—Stephen F. Gerrity
*Attorney, Agent, or Firm*—Friedrich Kueffner

[57] ABSTRACT

A method of and a device for manually tying bales of cardboard, foils and similar used packaging materials produced in waste material presses predominantly of upright construction, i.e., with a vertically acting pressure ram. The method includes the steps of separating the free end of the binding wire from the point where it is secured to the front side of the base and pulling out a free length of wire slightly exceeding the length of the dimensions of bale height plus bale depth, grasping the binding wire extending in a vertical groove in the rear wall of the press by means of the hook-shaped free end of the pulling needle, pulling the loop of binding wire formed in this manner by means of the pulling needle through the groove in the bottom of the pressure ram into a position located in front of the finished bale, separating the wire loop in the pulled-out position, and swinging upwardly the remaining length of wire at the bottom and tying together the two free ends of the binding wire.

1 Claim, 2 Drawing Sheets

METHOD OF MANUALLY TYING BALES IN WASTE MATERIAL PRESSES

BACKGROUND OF THE INVENTION

1. Field of the Invention

The present invention relates to a method of manually tying bales of cardboard, foils and similar used packaging materials produced in waste material presses predominantly of upright construction, i.e., with a vertically acting pressure ram.

The present invention also relates to a device for carrying out the method.

2. Description of the Related Art

In a known method of this type, for manually tying the finished pressed bale, the binding medium in the form of wire extending already along the bottom side and the rear side of the bale is pulled toward the front from a supply roll at a sufficient length by means of a pulling needle and the binding medium is tied together with the end of the binding medium which has previously been secured to the bottom side of the bale.

As long as the known easily bendable flat tape is used in this method, there are no problems. However, if strong wire must be used as binding medium for any reason or because of existing regulations, there is the problem that, in the known method described above, the wire must slide during the pulling procedure continuously in a loop angled over almost 180° over the hook-shaped free end of the pulling needle; it can be easily imagined that enormous forces must be applied by the operator carrying out this method.

SUMMARY OF THE INVENTION

Therefore, it is the primary object of the present invention to propose a novel method for surrounding the pressed bale manually with a wire while using as much as possible the system of the binding medium supply roll on the rear side of the press, in which the force required for pulling the binding wires can be reduced to a minimum.

In accordance with the present invention, the binding medium, particularly in the form of binding wire, is initially pulled from a supply roll at the rear side of the press. The binding medium is moved along the inner sides of the rear wall of the pressing chamber and along the bottom of the pressing chamber into the pressing chamber portion which is still empty and the binding medium is fastened to the front side of the base. After a bale has been produced and the front doors of the press have been opened, the binding medium is pulled by a so-called pulling needle having a hook-shaped free end through downwardly open grooves in the bottom surface of the pressure ram away from the rear wall of the pressing chamber toward the front and is tied to the free end of the binding medium which had been secured to the base prior to the beginning of pressing. The novel steps according to the present invention are, in succession, separating the free end of the binding wire from the point where it is secured to the front side of the base and pulling out a free length of wire slightly exceeding the length of the dimensions of bale height plus bale depth, grasping the binding wire extending in a vertical groove in the rear wall of the press by means of the hook-shaped free end of the pulling needle, pulling the loop of binding wire formed in this manner by means of the pulling needle through the groove in the bottom of the pressure ram into a position located in front of the finished bale, separating the wire loop in the pulled-out position, and swinging upwardly the remaining length of wire at the bottom and tying together the two free ends of the binding wire.

The device for carrying out the method according to the present invention has the following novel features. The point where the binding wire enters the rear wall of the press and the point where the binding wire is deflected in the area of the pressing plate or the bottom of the pressure ram have an increased radius or are constructed as deflection rollers. In addition, in the areas above and below the end position of the pressure ram when the bale is finished, the vertical grooves in the rear wall of the press have distance cams for keeping the binding wire extending along the rear wall of the press away from the rear wall of the channel or groove formed in the rear wall of the press.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
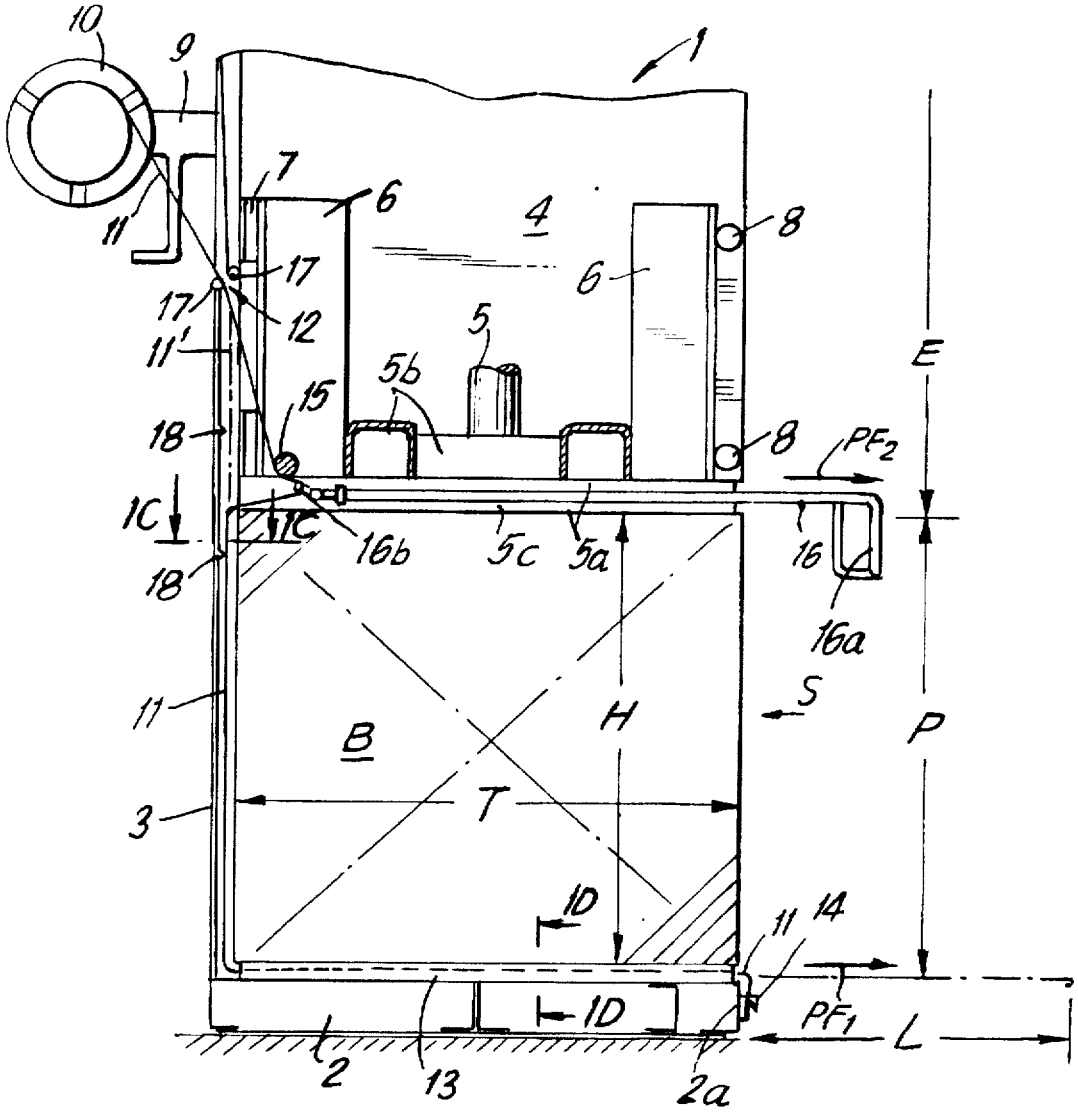
FIG. 1A is a schematic side view, partially in section, of a waste material press.
Figure 1B:
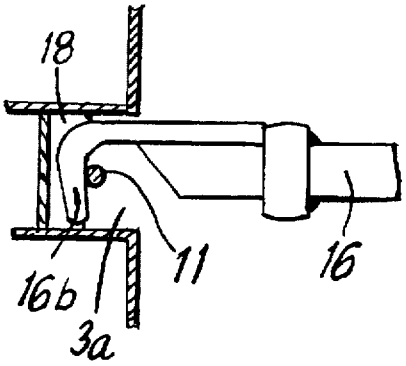
FIG. 1B is a partial sectional view showing the hook-shaped free end of the pulling needle in engagement with the binding wire in the vertical groove in the rear wall of the press.
Figure 1C:
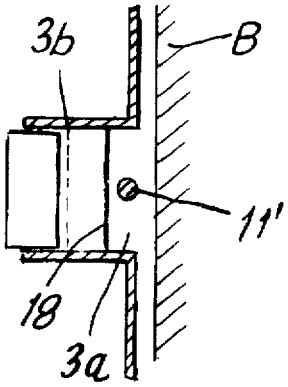
FIG. 1C is a sectional view taken along sectional line 1C—1C in FIG. 1A.

The waste material press 1 illustrated in FIG. 1A is basically composed of a housing base 2, a rear wall 3, side walls 4 and a pressure ram 5 vertically movable in a filling shaft E and a pressing shaft P of the waste material press. The pressure ram 5 is provided with a pressing plate **5*a*, an auxiliary frame 5*b* for reinforcing the pressing plate 5*a* and guide brackets 6 with slide members 7 and/or roller guide members 8. On the outside of the rear wall 3 of the press is arranged on the level of the filling shaft E a bracket 9 with a supply roll 10 for the binding wire 11 which, in the known manner, is placed prior to the beginning of a pressing procedure through an opening 12 in the rear wall 3 into grooves 3*a*, is pulled down to the housing base 2, is further moved through upwardly open guide channels 13 toward the front side S of the press and is secured by means of a hook 14 or the like at the front side 2*a* of the base 2**.

For clarity's sake, the front doors of the filling shaft E and the pressing shaft p are not illustrated in FIG. 1A.

Starting from the situation described above, the tying method according to the present invention for tying a waste material bale after opening the doors of the pressing shaft P and the filling shaft E, wherein the bale is indicated by the dimensions H and T in FIG. 1A, takes place as follows.

Initially, the binding wire 11 is separated from the hooking point 14 at the front side 2*a* of the base 2 and a free length L of wire slightly greater than the dimensions of the bale height H and the bale depth T is pulled in the direction of arrow $PF_1$. Subsequently, the so-called pulling needle 16 is used for grasping, by means of the hook-shaped free end 16*b* thereof, the binding wire 11' extending along the rear wall 3 of the press in the vertically extending groove 3*a* and for pulling the resulting binding wire loop 11, 11' by means of the pulling needle 16, 16*a* in the direction of arrow $PF_2$ through the groove 5*c* in the pressure ram bottom 5*a* into a position TR, shown in FIG. 2, in front of the finished bale B.

The novel feature of the method according to the present invention resides in that no relative movement occurs during the pulling procedure between the binding wire 11, 11' and the free hook end 16*b* of the pulling needle 16. This is because a wire reserve 11 which previously had been pulled out at the bottom by a length L, is pulled in accordance with arrow $PF_2$ by such a length that length $L_1$ corresponding approximately to the bale height H remains, and the second wire length 11' corresponding to the bale width T is pulled from the supply roll 10.

Accordingly, since no friction occurs between the wire loop 11, 11' and the pulling needle hook 16*b*, the pulling force $PF_2$ to be applied at the grip 16*a* of the pulling needle 16 is very small.

The following structural features of the waste material press 1 serve to further reduce the friction during the pulling process.

The point 12 where the binding wire enters the rear wall 3 of the press and the point 15 where the wire is deflected in the area of the pressure plate or the ram bottom 5*a* have a large radius or are constructed as deflection rollers 15 and 17, respectively.

The vertical grooves 3*a* in the rear wall 3 of the press have, in the areas above and below the end position of the pressure ram 5 when the bale 5 is finished, distance cams 18 for keeping the binding wire 11' away from the rear wall of the channel or groove 3*b* in the rear wall 3.

The feature mentioned last makes it primarily possible that the binding wire 11' is always spaced apart from the rear 3*b* of the groove by such an extent that the free end 16*b* of the pulling needle 16 can easily grasp the wire 11'.

Figure 2:
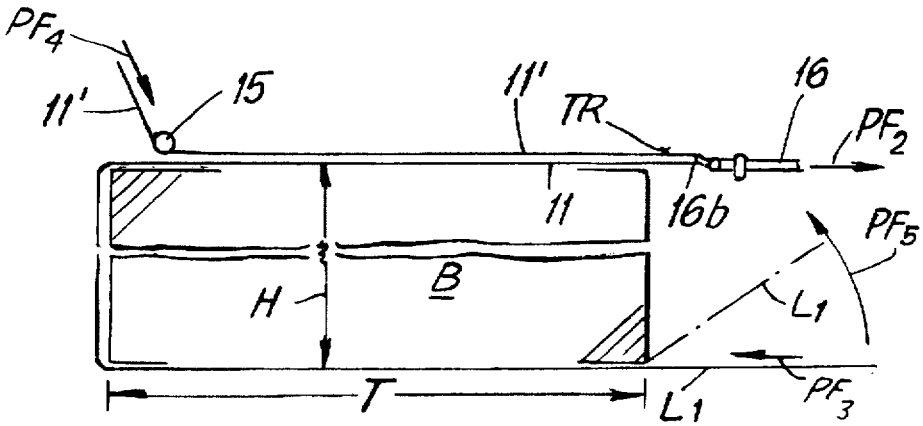
FIG. 2 shows a portion of the press of FIG. 1A to illustrate the binding process.
Figure 3:
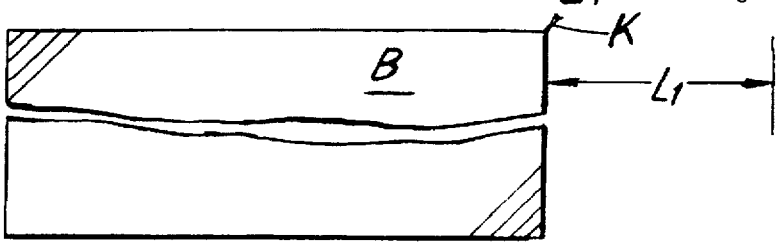
FIG. 3 is the same view as FIG. 2, showing the final position.

Finally, in accordance with the present invention, the wire loop 11, 11' is cut at the position TR in FIG. 2 and the remaining length $L_1$ of the wire at the bottom is swung upwardly in the direction of arrow $PF_5$ and a knot K is made to connect the free wire ends 11, 11', as shown in FIG. 3.

Figure 1D:
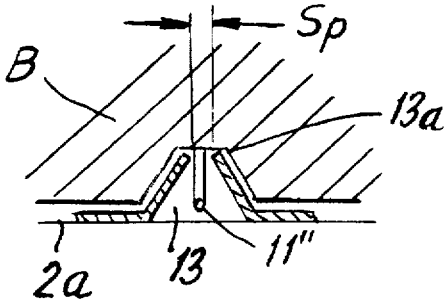
FIG. 1D is a sectional view taken along sectional line 1D—1D in FIG. 1A.

In accordance with another important feature illustrated in FIG. 1D, the channel-like grooves 13 provided on the upper side 2*a* of the base 2 for receiving and guiding the portions 11' of the binding wire 11 at the bottom, have a trapezoidally shaped cross section and the free ends 13*a* of the two trapezoid legs above the upper side 2*a* of the base 2 extend inclined relative to each other and form a narrow gap Sp which allows the binding wire 11" to be passed therethrough. In addition to a good centering of the wires 11, 11" during the tying procedure, this makes it especially possible that during the pressing procedure no foreign particles, such as, pressing materials or the like, can enter the grooves and clog the grooves.

In accordance with another useful feature, the two trapezoid legs 13*a* forming the grooves have equal lengths.

Of course, the concept according to the present invention can be used in modified construction also in so-called waste material presses of horizontal construction, i.e., those presses in which the pressure ram is moved horizontally.

The invention is not limited by the embodiments described above which are presented as examples only but can be modified in various ways within the scope of protection defined by the appended patent claims.

I claim:

1. In a method of manually tying bales of used packaging materials produced in a waste material press of upright construction, the press having a press chamber formed by a rear wall, side walls and front doors, and a pressure ram movable in the press chamber, the press chamber having a base, the method including initially pulling a binding wire from a supply roll at a rear side of the press, moving the binding wire along inner sides of the rear wall and along the base into a pressing chamber portion which is still empty and fastening the binding wire to a front side of the base, and, after a bale has been produced and the front doors of the press have been opened, pulling the binding wire by means of a pulling needle having a hook-shaped free end through a downwardly open groove in a bottom surface of the pressure ram away from the rear wall toward the front, and tying the binding wire pulled by the pulling needle to a free end of the binding wire secured previously to the base prior to pressing, the improvement comprising separating the free end of the binding wire from the front side of the base and pulling out a free length of wire slightly exceeding a length of the dimensions of bale height plus bale depth, grasping the binding wire extending in a vertical groove of the rear wall of the press by the hook-shaped free end of the pulling needle, pulling the resulting loop of binding wire by the needle through the groove in the bottom of the pressure ram into a position located in front of the finished bale, separating the wire loop in the pulled-out position, and swinging upwardly a remaining length of wire at the bottom and tying together the two free ends of the binding wire.

* * * * *